US010145587B2

(12) United States Patent
Ascani

(10) Patent No.: US 10,145,587 B2
(45) Date of Patent: Dec. 4, 2018

(54) REFRIGERATION DEVICE

(71) Applicant: ANGELANTONI TEST TECHNOLOGIES S.R.L., Massa Martana (PG) (IT)

(72) Inventor: Maurizio Ascani, Massa Martana (PG) (IT)

(73) Assignee: ANGELANTONI TEST TECHNOLOGIES S.R.L., Massa Martana (PG) (IT)

( * ) Notice: Subject to any disclaimer, the term of this patent is extended or adjusted under 35 U.S.C. 154(b) by 0 days.

(21) Appl. No.: 15/534,583

(22) PCT Filed: Dec. 11, 2015

(86) PCT No.: PCT/IB2015/059532
§ 371 (c)(1),
(2) Date: Jun. 9, 2017

(87) PCT Pub. No.: WO2016/092512
PCT Pub. Date: Jun. 16, 2016

(65) Prior Publication Data

US 2017/0343244 A1 Nov. 30, 2017

(30) Foreign Application Priority Data

Dec. 11, 2014 (IT) ..... PG2014A0063

(51) Int. Cl.
*F25B 1/02* (2006.01)
*F25B 41/06* (2006.01)

(52) U.S. Cl.
CPC ..... *F25B 1/02* (2013.01); *F25B 41/062* (2013.01); *F25B 2341/0661* (2013.01); *F25B 2400/0409* (2013.01); *F25B 2400/13* (2013.01)

(58) Field of Classification Search
CPC .. F25B 1/00; F25B 13/00; F25B 9/008; F25B 1/02; F25B 41/062; F25B 2341/0661; F25B 2400/0409; F25B 2400/13
See application file for complete search history.

(56) References Cited

U.S. PATENT DOCUMENTS

2008/0236179 A1 10/2008 Ignatiev et al.
2014/0170003 A1 6/2014 Bergman et al.
2017/0343244 A1* 11/2017 Ascani ..... F25B 1/02

FOREIGN PATENT DOCUMENTS

EP 2357427 A1 8/2011
EP 2792974 A1 10/2014
(Continued)

OTHER PUBLICATIONS

International Search Report and Written Opinion for International Application No. PCT/IB2015/059532 (dated Mar. 31, 2016) (12 Pages).

(Continued)

*Primary Examiner* — Melvin Jones
(74) *Attorney, Agent, or Firm* — Lucas & Mercanti, LLP

(57) ABSTRACT

A refrigeration device having a closed circuit in which a flow rate of coolant is circulating is provided. The closed circuit has a condenser and a main branch provided with a reciprocating compressor inside which a defined flow rate of the coolant enters, from the main branch, at a defined suction pressure, of an evaporator and a first expansion valve that is arranged between the condenser and the evaporator. The closed circuit further has a first secondary economizer branch for a first fraction of flow rate of the coolant, the first secondary economizer branch fluidically connecting the compressor to a section of the closed circuit between the condenser and the first expansion valve, wherein the compressor has a first side inlet port for the entrance of the first fraction of coolant flow rate.

13 Claims, 6 Drawing Sheets

(56) References Cited

FOREIGN PATENT DOCUMENTS

| | | | |
|---|---|---|---|
| WO | 9716649 | A1 | 5/1997 |
| WO | 2007064321 | A1 | 6/2007 |

OTHER PUBLICATIONS

Italian Search Report for Corresponding Italian Application No. ITPG20140063 (dated Jul. 30, 2015) (2 Pages).

* cited by examiner

REFRIGERATION DEVICE

CROSS-REFERENCE TO RELATED APPLICATIONS

This application is a 371 of PCT/IB2015/059532 filed Dec. 11, 2015, which claims the benefit of Italian Patent Application No. PG2014000063 filed Dec. 11, 2014.

FIELD OF THE INVENTION

The present invention relates to a refrigeration device.

KNOWN PREVIOUS ART

In particular, the refrigeration device according to the invention is advantageously used in case the closed circuit, in which the coolant flows, comprises in addition to the condenser, the expansion valve and the evaporator, also a reciprocating compressor and a secondary economizer branch for the coolant circulating in the same closed circuit. It has to be noted that, according to known art, such a secondary branch is fluidically connected to a section of the main branch of the closed circuit comprised between the condenser and the expansion valve, on the one hand, and to the cylinder of the reciprocating compressor for the re-injection, into the compressor itself, of the fraction of flow rate crossing the secondary branch, on the other hand. Still in a known way, such a secondary economizer branch comprises an expansion valve and a heat exchanger and the flow rate coming from the secondary economizer branch and entering the compressor cylinder, has a pressure intermediate between the highest and the lowest pressure of the circuit of the refrigeration device, i.e. between the fluid pressure at the condenser and that one at the evaporator.

In general, in compressors usually adopted in refrigeration devices, the exact point of the compression chamber of the compressor in which the aforementioned fraction of flow rate coming from the secondary economizer branch is entered, can always be determined. For example, in a screw compressor, in which as it is known the pressure increases along the compressor axis according to a known law, the exact point of injection of the fraction of flow rate coming from the secondary economizer branch can always be located. The same applies also for other types of compressors such as, for example, screw or scroll compressors, although the operating principle as well as the pressure distribution inside the compression chamber are different with respect to that one of the screw compressors, however also in the scroll compressor it can always be known how great is the pressure in any point of the compression chamber.

In case of use of reciprocating compressors, i.e. provided with cylinder and piston reciprocatingly moving inside the cylinder, the pressure instead varies with time and is anytime substantially the same in the whole cylinder for every position of the piston in the cylinder during its inlet and compression stroke.

However, in order to allow using secondary economizer branches in refrigeration devices having a reciprocating compressor, in document US 2014/0170003 in the name of Emerson Climate Technologies Inc. the use of cylinders provided with a side inlet port for the entrance of such a fraction of flow rate from a secondary economizer branch at a defined intermediate pressure, is described. At the side inlet port being in the compressor cylinder a valve is located whose opening and closing is synchronized with the compressor drive shaft through a complicated mechanism consisting of at least one cam and at least one respective follower. This allows the aforementioned fraction of flow rate of coolant coming from the secondary economizer branch to be entered only shortly before a pressure slightly smaller than the pressure of the afore mentioned fraction of secondary flow rate is reached in the piston.

In order to avoid using complex synchronization systems, as those described in US 2014/0170003, other solutions have been studied. In particular, in document WO-A1-2007064321 in the name of Carrier Corporation, it is taught how to implement on the compressor cylinder a side inlet port that is exposed by the piston in its inlet stroke and remains covered, still by the piston, during the compression stroke of the latter. In such a compressor, however, the piston speed and thus the flow rate circulating in the circuit of the refrigeration device are varied, as a function of the target temperature in the room to be refrigerated. All of this in order to achieve a fine regulation of the temperature inside the same room to be refrigerated that can be, for example, a container or the like, with the ultimate effect of increasing also the efficiency of the refrigeration device itself. However, such a refrigeration device is not free from drawbacks. In fact, the possible and alleged fine obtained control occurs to the detriment of the efficiency possibly reached by using a secondary economizer branch. In addition, a so-made refrigeration device involves however a significant increase of the same compressor complexity since the piston motion speed has always to be driven as a function of one or more external parameters.

On the other hand it has to be added that in all the afore described refrigeration devices as long as provided with secondary economizer branch, independently from the type of compressor used, the pressure of the fraction of flow rate of coolant from the secondary branch is always remarkably higher than the pressure of the fluid entering the compressor through the conventional suction duct, thus through the suction valve being on the cylinder head. In particular, according to known art, there are two calculus methods used for defining the pressure of the secondary economizer branch that optimizes the efficiency of the refrigeration device. According to the first method, the fluid pressure along the secondary economizer branch is given by the geometric mean between the pressure at the condenser and the one at the evaporator. By exemplifying, if the pressure of the coolant at the evaporator is 1.31 bar and that one at the condenser is 18.3 bar, then the pressure of the fluid flowing through the secondary economizer branch, in order to optimize the efficiency in the refrigeration device, is 4.93 bar (i.e. given by the square root of the product of the aforementioned pressure values). In accordance with the second method, the pressure of the fluid along the secondary economizer branch is given by the pressure corresponding to the temperature of saturated gas obtained by calculating the mean value between the evaporator and the condenser temperatures, yet with the saturated fluid. By exemplifying, if the temperature of saturated fluid at the condenser is 40° C. and at the evaporator is −40° C., then the average temperature between these two values is 0° C. The pressure of saturated fluid corresponding to this temperature is 6.1 bar. This is obtained by selecting the fluid R404a as cooling gas, that is however one of the most common coolants commercially used. On the other hand it has to be noted that for the other commercially available coolants the result would have probably been different, but the deviation from the aforementioned value absolutely poorly significant.

In general the field technician, once done the calculation by using the two aforementioned methods, takes the average of the two so-obtained values as the pressure of the fraction of fluid circulating in the secondary branch. In the present instance, the selected value would be of 5.51 bar.

Regardless of the afore shown specific example, in general the pressure difference between the pressure of the fluid entering the compressor through the suction valve and the pressure of the fluid flowing into the cylinder through a side port on the cylinder, usually is around values higher than 5 bar. In fact, such a pressure difference was found to be the one that allows optimizing the efficiency of the refrigeration device and thus that one adopted by all the manufacturers of refrigeration devices.

Such a pressure difference between the pressure of the fraction of coolant flow rate from the secondary branch and the pressure of the fluid entering the compressor through the conventional suction duct, is not so advantageous in case of use of the refrigeration device provided with reciprocating compressor and with side inlet port for the entrance of a flow rate along an economizer branch.

SUMMARY OF THE INVENTION

Object of the present invention is, therefore, to increase the efficiency of the refrigeration devices operating with reciprocating compressor, without neither increasing the complexity of the refrigeration device nor that one of the reciprocating compressor operating inside the refrigeration device.

Further object of the invention is to increase the refrigeration load of the refrigeration device according to the invention, the displacement of the reciprocating compressor operating in known refrigeration devices being equal.

These and other objects are reached by the refrigeration device having a closed circuit in which a flow rate of coolant is circulating, said closed circuit comprising at least one condenser and at least one main branch provided with at least one reciprocating compressor inside which a defined flow rate of said coolant enters, from said main branch, at a defined suction pressure, with at least one evaporator and at least one first expansion valve that is arranged between said at least one condenser and said at least one evaporator, said closed circuit further comprising at least one first secondary economizer branch for at least one first fraction of flow rate of said coolant, said at least one first secondary economizer branch fluidically connecting said compressor to a section of said closed circuit comprised between said condenser and said at least one first expansion valve; advantageously said reciprocating compressor comprises at least one first side inlet port for the entrance of said at least one first fraction of coolant flow rate, said at least one first fraction of flow rate having an inlet pressure so that $P_8-P_1 \leq 4$ bar.

The Owner has in fact tested that the entrance of a first fraction of flow rate from a secondary economizer branch through a first port placed on the compressor cylinder, at an inlet pressure higher than the suction pressure and, however, not higher than 4 bar with respect to the latter, and preferably lower than 2 bar, allows reaching multiple results. In fact, thanks to this solution the efficiency of the refrigeration cycle becomes greatly increased with respect to a refrigeration cycle working at the same operating conditions, i.e. same pressures, temperatures and same coolant. In addition, such a solution also allows greatly increasing the refrigeration load, the displacement of the employed reciprocating compressor being the same. This is mainly due to the fact that, when the pressure of said at least one first fraction of flow rate of coolant from the first secondary economizer branch is reduced, a remarkable increase of the volumetric flow rate is obtained that, consequently, greatly increases the cylinder pressure when enters the compressor through said first port, thus resulting in a reduction of the compression work done by the compressor. Such a reduction of compressor work leads to a remarkable increase of the efficiency of the whole refrigeration device.

According to a characteristic aspect of the invention, said at least one reciprocating compressor is provided with at least one cylinder and at least one piston reciprocatingly moving in said at least one cylinder, between a top dead centre and a bottom dead centre, said at least one inlet port for the entrance of said at least one first fraction of flow rate of said coolant being arranged at the bottom dead centre of said at least one piston, so that said piston exposes at least in part said at least one inlet port, at least during its inlet stroke, and covers said at least one port, at least during its compression stroke.

In practice, the more the inlet port will be close to the bottom dead centre of the piston, the less will be the work of the piston in its inlet and compression steps. In addition, the more the inlet port will be close to the bottom dead centre of the piston, the less will be the loss of piston stroke in the period of time the side port remains exposed. Therefore, such a solution allows maximizing the efficiency of the refrigeration device according to the invention.

According to a particular aspect of the invention, said at least one closed circuit further comprises at least one additional secondary economizer branch for at least one second fraction of flow rate of said coolant, said compressor comprising at least one second inlet port for the entrance of said at least one additional fraction of flow rate of coolant into said at least one compressor, in which said at least one second port is arranged at a distance from said bottom dead centre greater than the distance at which said at least one first port is arranged, said additional fraction of flow rate having an inlet pressure so that $P_1 \leq P_{10} \leq P_8$, wherein $P_{10}-P_1 \leq 2$ bar and preferably lower than 1 bar. Such a solution results in a further and significant increase of the efficiency and refrigeration load with respect to a conventional use, all the operative conditions of the refrigeration device being the same.

According to the invention, said at least one first inlet port and/or said at least one second inlet port comprises/comprise a slit with main dimension substantially transverse to the axis of said cylinder, i.e. lying on a plane substantially transverse to the axis of said at least one cylinder. In practice, in order to reduce as much as possible the compression work of the cylinder, during its rising along the piston, to close said first and/or said at least one second port, both said at least one first port and said at least one second port must have a dimension along the cylinder axis as reduced as possible; however the main dimension of the slit, i.e. on a plane transverse to the cylinder axis, must be adequately extended to allow the entrance of the greatest fraction of flow rate of available coolant in the shortest possible time.

It has to be observed that the term slit has to be intended as any notch, of any shape, made in the cylinder wall and having a dominant dimension (also named as main dimension) with respect the other. In particular, in the present instance, the main or dominant or more relevant dimension is the one lying on a plane transverse to the axis of the compressor cylinder, thus not the slit dimension parallel to the axis of the compressor cylinder and defined as slit height.

According to the embodiment herein described, said at least one first port and said at least one second port, both having a slit shape, are substantially or mainly rectangular-shaped, i.e. the slit surface, that one facing the inner face of the compressor cylinder, has substantially the shape of a rectangle lying on the inner cylindrical surface of the compressor cylinder. Such a substantially rectangular shape, where the top or bottom side has dimensions greatly larger than those of the two height sides, i.e. along the axial direction of the compressor cylinder, could also have sides blent one to another, i.e. without sharp edges, falling however in the definition of surface having substantially a shape of rectangle lying on the inner surface of the cylinder.

In particular, said substantially rectangular-shaped slit has the ratio between the height dimension and the length dimension, or main dimension, smaller than 0.5, preferably than 0.2.

Advantageously, said at least one first port has a lower side substantially flush with the bottom dead centre of said piston. In addition, the lower side of said at least one second port is flush with the upper side of said at least one first port. In this way, said at least one first port and said at least one second port are at the shortest possible distance with respect to the bottom dead centre of the piston.

According to a particular embodiment of the invention, said at least one secondary economizer branch and/or said at least one additional secondary branch comprises/comprise at least one pipe having a cylindrical section and at least one fitting with said at least one first inlet port and/or said at least one second inlet port. In greater detail, said cylindrical pipe is dimensioned so that to be of tuned type. Such a definition is well known to the field technician operating in the field of internal combustion engines and, in practice, this means that such a pipe is dimensioned, in length and diameter, and shaped so that the pressure wave propagating in the pipe at the opening of the first or the second port, due to the pressure difference between the pressure in the cylinder chamber and the pressure of the fraction of flow rate entering the cylinder, always and in any case promotes the cylinder filling and keeps low the pressure of the secondary economizer branch. This is obtained also in situations in which the cylinder pressure is, for some fractions of a second, higher than the pressure being in the cylindrical pipe for the entrance of the flow rate flowing along the secondary economizer branch and/or said at least one additional secondary branch.

Finally, said at least one first inlet port and/or said at least one second inlet port comprises/comprise at least one functionally-combined non-return valve. In this way, the gas being in the cylinder during the compression step of the piston and once the pressure of the fraction of flow rate from the first or second port has been exceeded, can not be re-entered, even for a single fraction of a second, into said at least one secondary economizer branch and/or said at least one additional secondary economizer branch. Such a non-return valve is of deformable reed type and is preferably housed in the wall of said at least one cylinder.

BRIEF DESCRIPTION OF THE DRAWINGS

For illustration purposes only, and without limitation, several particular embodiments of the present invention will be now described referring to the accompanying figures, wherein.

DETAILED DESCRIPTION OF PREFERRED EMBODIMENTS OF THE INVENTION

Referring in particular to such figures, the generic refrigeration device according to the invention has been denoted with numeral 100.

Figure 3B:
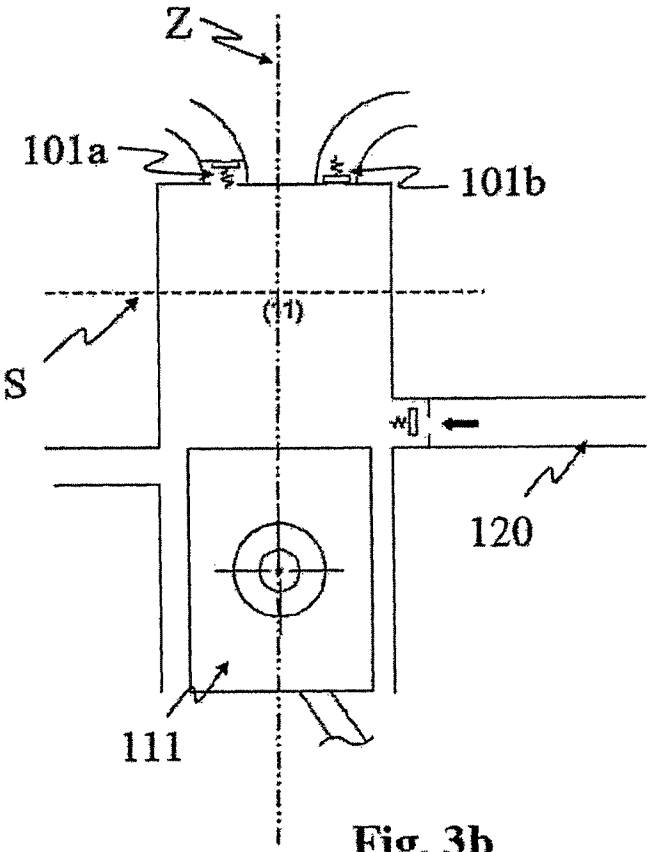
FIGS. 3*a*-3*d* are schematic and sectional views of the inside of the compressor cylinder during the inlet and compression steps, in reference to the thermodynamic states shown in FIG. 2.
Figure 3A:
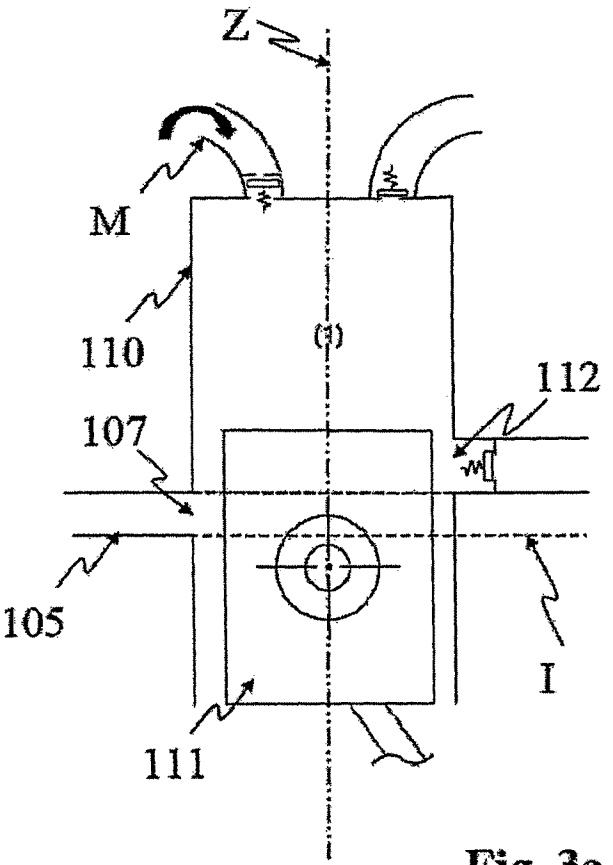
Figure 3D:
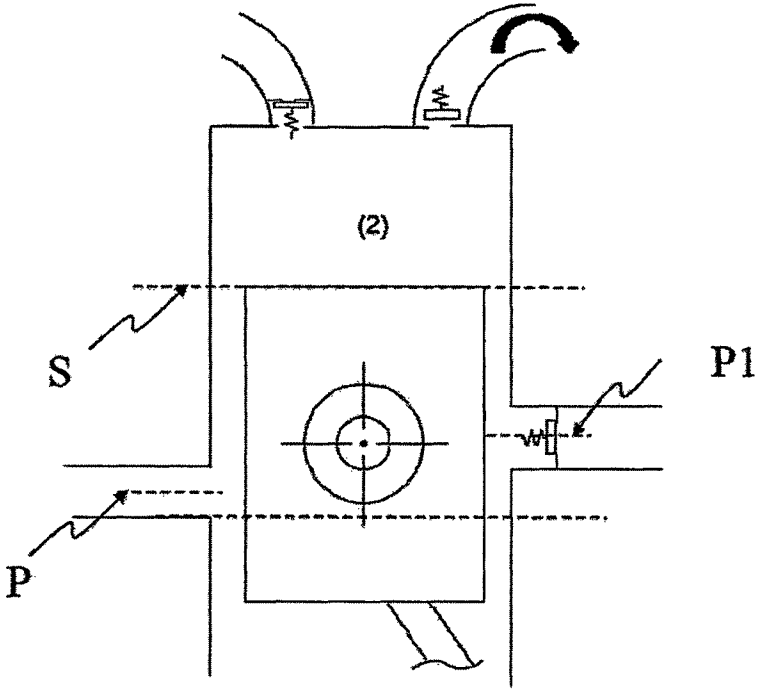
Figure 3C:
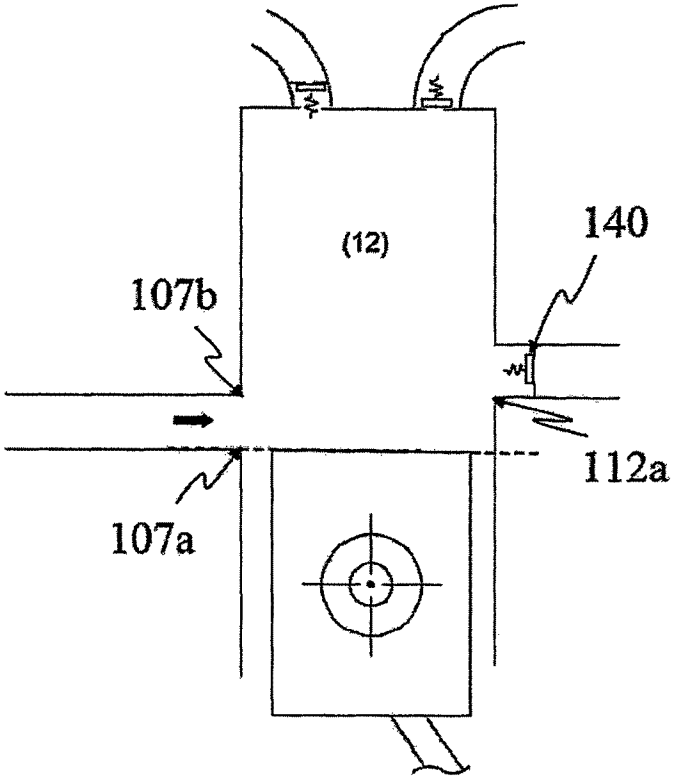

The refrigeration device 100 comprises a closed circuit C in which a flow rate of coolant 1 is circulating. Such a closed circuit C comprises a condenser 102 and a main branch M having a reciprocating compressor 101 provided with a cylinder 110 and a piston 111 reciprocatingly moving inside the cylinder 110, between a top dead centre S (see FIG. 3*d*) and a bottom dead centre I (see FIG. 3*c*), and inside which a defined flow rate 1–X1–X2 of the coolant enters, from said main branch M, at a defined suction pressure $P_1$. Such a main branch M is further provided with an evaporator 103 and a first expansion valve 104 arranged between the condenser 102 and the evaporator 103. Such a closed circuit C comprises, in addition, a first secondary economizer branch 105 for a first fraction of flow rate X1 of the coolant. Such a first secondary economizer branch 105 is fluidically connected to the compressor 101 and to a section 106 of the closed circuit C comprised between the condenser 102 and the expansion valve 104. According to the invention, the reciprocating compressor 101 comprises a first side port 107 obtained on the wall 110*a* of the cylinder 110 for the entrance of the aforementioned first fraction X1 of flow rate of coolant.

Figure 1:
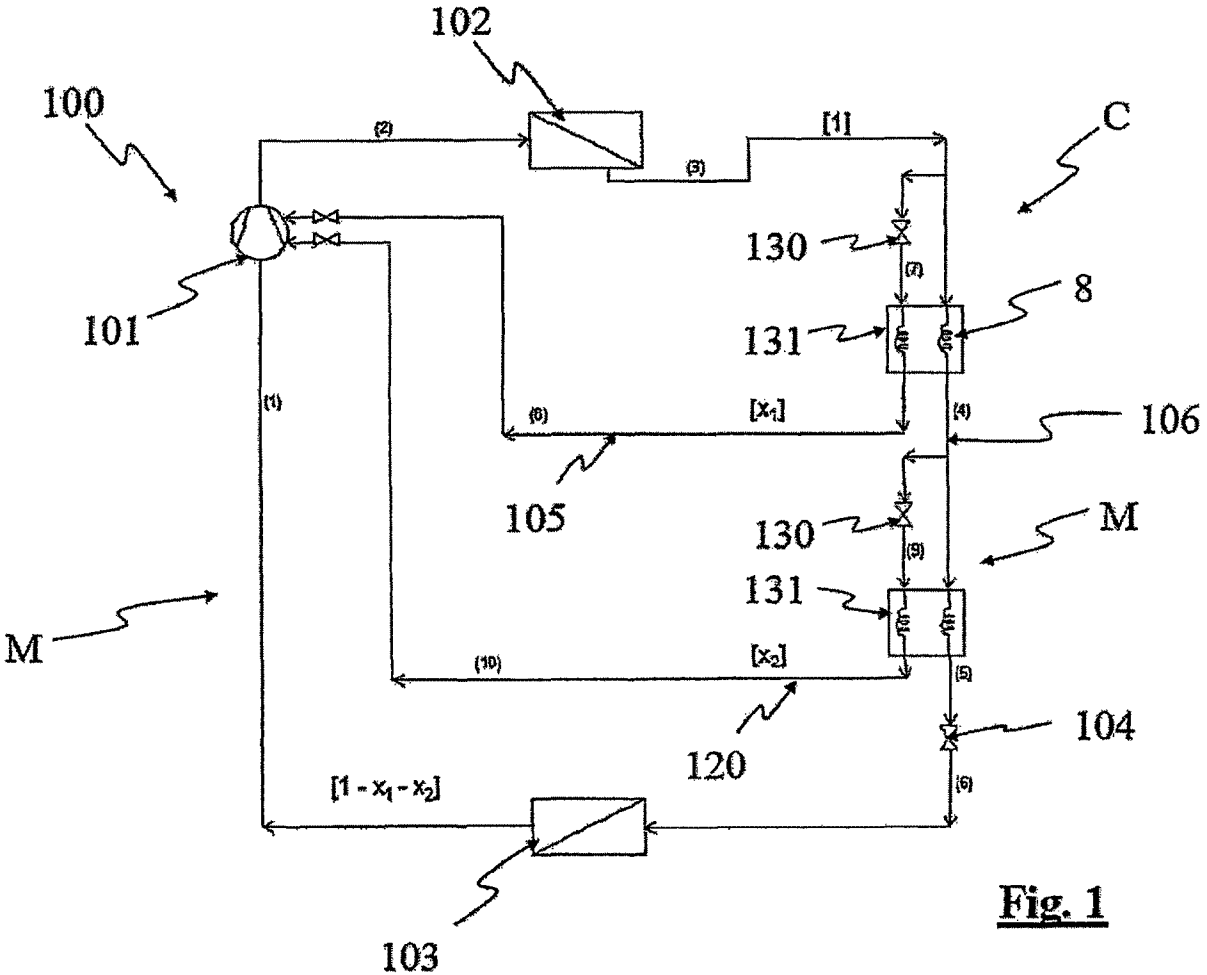
FIG. 1 is a schematic view of a refrigeration device according to the invention, with two secondary economizer branches.

Note that in FIG. 1 the thermodynamic states of the coolant circulating in the closed circuit C of the refrigeration device 100 are denoted in brackets, with numbers from 1 to 12. Then, in FIG. 2 the thermodynamic cycle made by the coolant in the closed circuit 100 is shown, with the information of the thermodynamic condition of the fluid at the corresponding points of the closed circuit C.

Advantageously and according to the invention, such a first fraction of flow rate X1 has an inlet pressure $P_8$ in the cylinder 110 of the compressor 101 so that $P_8-P_1 \leq 4$ bar, and preferably lower than 2 bar, wherein $P_1$ is the pressure of the flow rate of the fluid 1–X1–X2 entering the cylinder 110 of the compressor 101 from the suction valve 101*a*, during the inlet step of the compressor 101. In practice, the Owner found that by increasing the specific volume of the fluid introduced in the cylinder through the first secondary economizer branch 105, i.e. by reducing the inlet pressure $P_8$ to the cylinder 110 through the first side port 107 as much as possible, several advantages are achieved. Firstly, thanks to such a solution, the efficiency of the refrigeration cycle becomes greatly increased with respect to a refrigeration cycle working at the same conditions, i.e. same pressures, temperatures and same coolant. In addition, such a solution also allows greatly increasing the refrigeration load, the displacement of the employed reciprocating compressor 101 being the same. This is mainly due to the fact that, when the pressure $P_8$ of said first fraction X1 of flow rate of coolant from the first secondary economizer branch 105 is reduced, a remarkable increase of the volumetric flow rate is obtained that, consequently, greatly increases the pressure of the cylinder 110 when enters the compressor 101 through said first port 107, thus resulting in a reduction of the compression work done by the compressor 101. Such a reduction of the work of the compressor 101 leads to a great increase of the efficiency of the whole refrigeration device 1. In addition, such a solution also allows greatly increasing the refrigeration load, the displacement of the employed reciprocating compressor 101 being the same.

According to the herein disclosed embodiment, the first inlet port 107 for the first fraction X1 of flow rate of the coolant, that in the present instance is R404a, is arranged at the bottom dead centre I of the piston 111, so that the piston exposes the first inlet port 107 during its inlet stroke and covers such a first inlet port 107 during its compression stroke.

In the herein described embodiment, the closed circuit C further comprises an additional secondary economizer branch 120 for a second fraction of flow rate X2 of the coolant. Thus the compressor 101 comprises a second inlet port 112 for the entrance of such an additional fraction X2 of flow rate of the coolant. Specifically, the second inlet port 112 is arranged at a distance from the bottom dead centre I of the piston 111 greater than the distance at which the first port 107 is located; such an additional fraction of flow rate X2 has an inlet pressure $P_{10}$ so that $P_1 \leq P_{10} \leq P_8$, in which $P_{10}-P_1 \leq 2$ bar and preferably lower than 1 bar.

Note that the aforementioned distance between the first port 107, or the second port 112, and the bottom dead centre I is measured along the axis Z of the cylinder 110 from the bottom dead centre of the piston 111 of the compressor 101 to the lower side 107*a*, or 112*a*, of the respective port.

Figure 2:
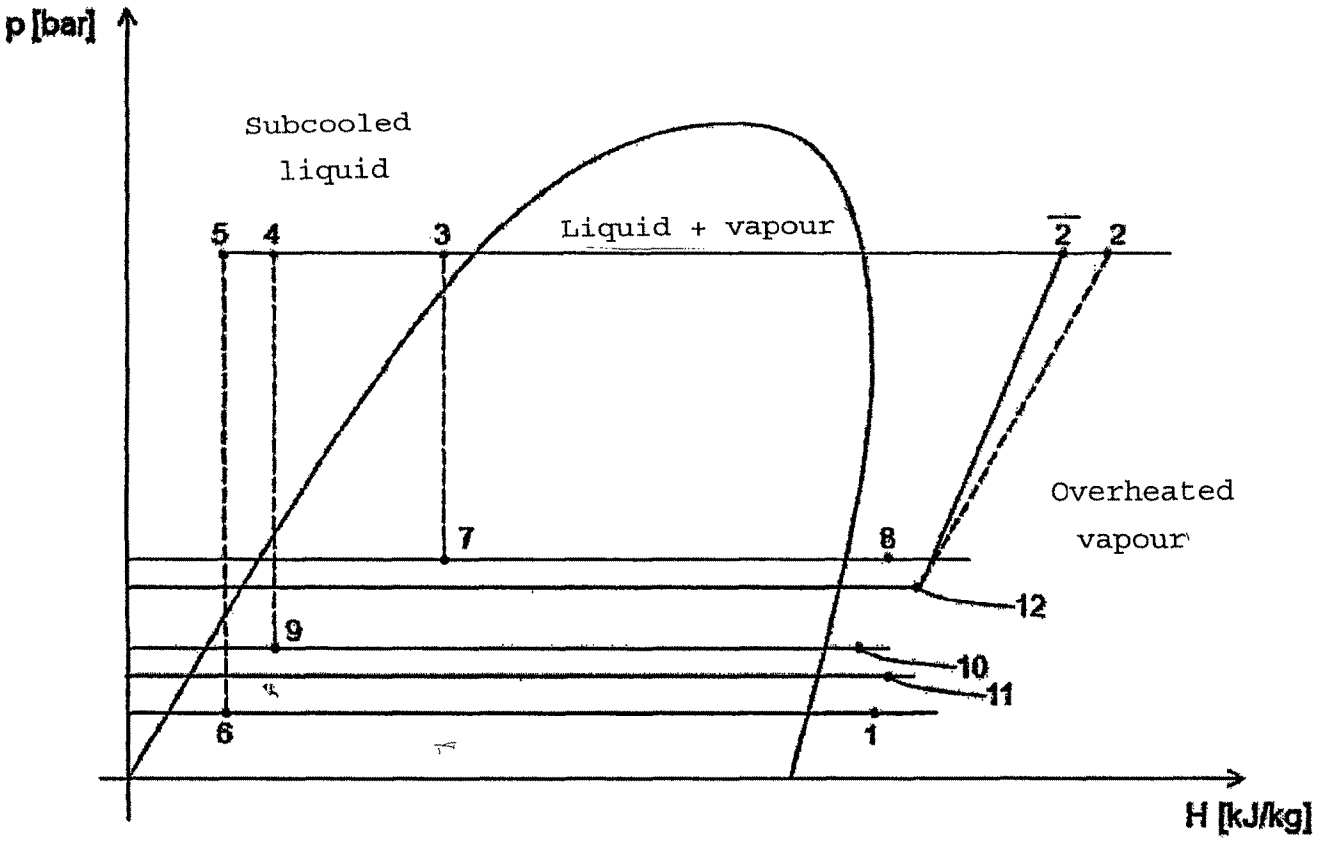
FIG. 2 is a P-H diagram of the refrigeration cycle used in the refrigeration device of FIG. 1.

Still according to the herein described embodiment, the first secondary economizer branch 105 and the additional secondary economizer branch 120 comprise a second expansion valve 130 and at least one heat exchanger 131 with the section 106 of the closed circuit C comprised between the condenser 102 and the expansion valve 104. At this point, for simplification purposes, a numerical example of the refrigeration device according to the invention is shown. In particular, it has to be observed that the thermodynamic cycle made by the coolant inside the closed circuit C is depicted in FIG. 2. Also in this case the numeral references located at the lines describing the thermodynamic transformations experienced by the coolant in the refrigeration device 100 are also detectable in the closed circuit C of the refrigeration device 100 shown in FIG. 1.

In the numerical example the condensation temperature is supposed to be 40° C., and the evaporation temperature −40° C. In addition, the subcooling at the outlet of the condenser is supposed to be of 2° C., whereas the overheating at the outlet of the evaporator to be of 5° C. In addition, in the herein described cycle, the overheating of the economizer vapor is supposed to be of 15° C., whereas the difference between the temperature of the subcooled fluid and the evaporation temperature to be of 5° C. Now, by using an iterative method and starting from pressure values $P_8$ and $P_{10}$ of respectively 3.0 bar and 1.55 bar of the fluid being respectively in the secondary economizer branch 105 and in the additional secondary economizer branch 120, the values of pressure (P), temperature (T), enthalpy (h), density (σ) and entropy (S) of the thermodynamic states 1, 3, 4, 5, 6, 7, 8, 9 e 10 can be determined. Subsequently, being the state 11 the thermodynamic state reached by the fluid at the mixing of vapor in the state 1 with the vapor produced in the additional economizer branch 120 at the thermodynamic state 10, it is calculated only once the fractions X1 and X2 of flow rate of the coolant in the first economizer branch 105 and in the additional secondary economizer branch 120 have been determined.

In particular, it turns out that:

$$X1=(h_3-h_4)/(h_8-h_4)=0.408$$

and $$X2=(1-X1)*(h_4-h_5)/(h_{10}-h_5)=0.065$$

wherein $h_3$, $h_4$, $h_5$, $h_8$, and $h_{10}$ are the enthalpy values at the corresponding thermodynamic states visible in FIGS. 1 and 2, whereas 1 denotes the unit numerical value of the overall flow rate 1 of the coolant circulating in the closed circuit C.

Then, once the thermodynamic characteristics of the fluid at the thermodynamic state 12 have been determined, i.e. when the fluid coming from the secondary branch 105, at the thermodynamic state 8, mixes to the fluid being in the cylinder 110 at the thermodynamic state 11, the physical state 2' relating to an isentropic compression can be calculated by fixing the value of 0.7 as the efficiency η of the compressor 101. From here, the value of the fluid at the thermodynamic state 2, i.e. exiting from the compressor 101, can be calculated.

In summary, the physical states of the fluid in the thermodynamic cycle according to the herein described embodiment, in view of the employed and afore mentioned hypotheses, are the following:

| | P | T | h | σ | S | X |
|---|---|---|---|---|---|---|
| 1 | 1.31 | −35 | 347.6 | 6.81 | 1.6563 | |
| 2 | 18.3 | 77.7 | 427.3 | 75.58 | 1.7266 | |
| 3 | 18.3 | 38 | 256.8 | 978 | 1.1903 | |
| 4 | 18.3 | −15 | 179.9 | 1211 | 0.9205 | |
| 5 | 18.3 | −32 | 157.9 | 1267 | 0.8321 | |
| 6 | 1.31 | −40 | 157.9 | | 0.8388 | 0.059 |
| 7 | 3.07 | −20 | 256.8 | | 1.2293 | 0.461 |
| 8 | 3.07 | −5 | 368.3 | 14.58 | 1.6678 | |
| 9 | 1.55 | −37 | 179.9 | | 0.9312 | 0.149 |
| 10 | 1.55 | −22 | 357.5 | 7.62 | 1.6806 | |
| 11 | 1.50 | −29.8 | 351.2 | 7.63 | 1.6580 | |
| 12 | 2.74 | −6.6 | 367.7 | 12.99 | 1.6744 | |
| 2' | 18.3 | 62.4 | 409.4 | 83.35 | 1.6744 | |

In view of such values the coefficient of performance, or more commonly known with the acronym COP, is the following:

$$COP=[(1-X1-X2)*(h_1-h_6)]/[h_2-(1-X1-X2)*h_1-X1*h_8-X2*h_{10}]=1.42$$

wherein $h_1$, $h_2$, $h_6$, $h_8$ and $h_{10}$ are the enthalpy values of the corresponding thermodynamic states that can be seen in FIGS. 1 and 2.

Figure 5B:
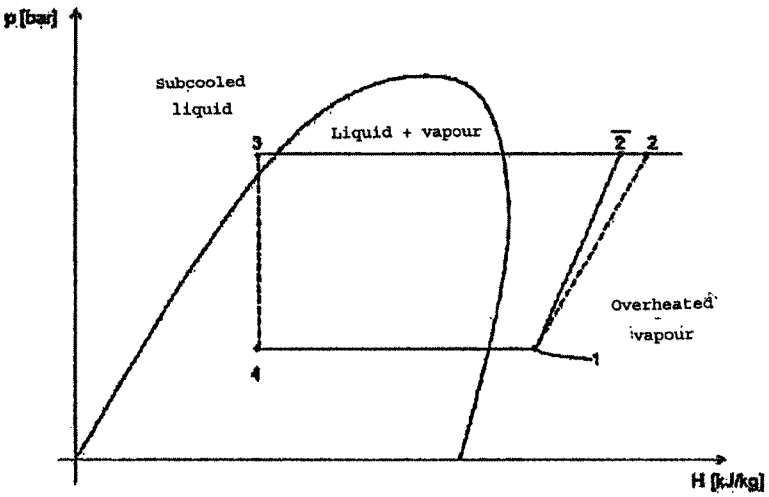
FIG. 5*b* shows a P-H diagram of the refrigeration cycle adopted in the refrigeration device of FIG. 5*a*.
Figure 5A:
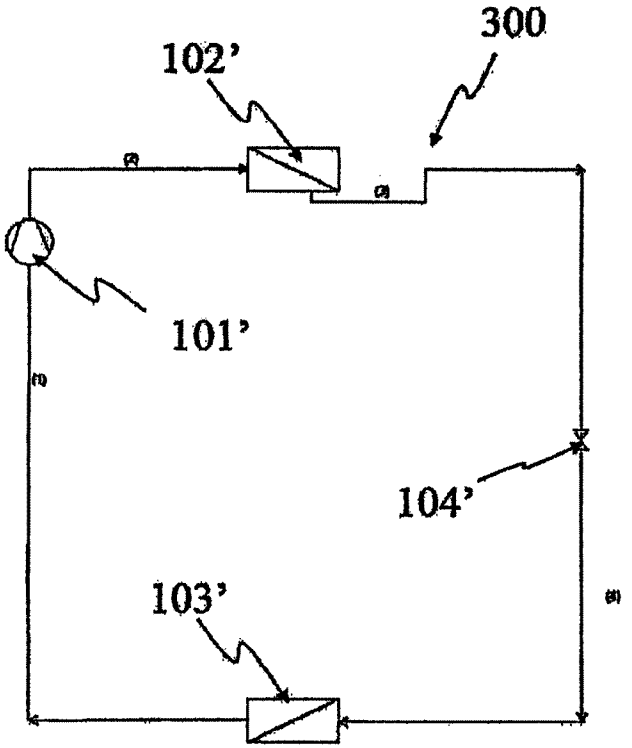
FIG. 5*a* shows a schematic view of a conventional refrigeration device with reciprocating compressor and without one or more secondary economizer branches.

On the contrary, in case of conventional refrigeration device 300 shown in FIG. 5*a*, i.e. provided with the condenser 102', expansion valve 104', evaporator 103' and reciprocating compressor 101' and free of secondary economizer branches, and whose thermodynamic cycle is depicted in FIG. 5*b*, and starting from the same working hypotheses, i.e. same condensation temperature, outlet temperature at the condenser, evaporation temperature, overheating at the evaporator outlet, entropic efficiency of the compressor, and coolant, the following values in the various thermodynamic states shown in FIGS. 5*a* and 5*b* would be obtained:

| | P | T | h | σ | S |
|---|---|---|---|---|---|
| 1 | 1.31 | −35 | 347.6 | 6.81 | 1.6536 |
| 2 | 18.3 | 56.7 | 402.5 | 87.01 | 1.6536 |
| 3 | 18.3 | 76.5 | 426.0 | 76.06 | 1.7229 |
| 4 | 18.3 | 38 | 256.8 | 978 | 1.1703 |
| 2' | 1.31 | −40 | 256.8 | 12.40 | |

Hereupon, the following coefficient of performance would be obtained:

$$COP'=(h_4)/(h_2-h_1)=1.16$$

In practice, thanks to the herein described solution, a COP is obtained that is 22.4% greater than the COP' that could be obtained by a conventional refrigeration device 300 however operating at the same thermodynamic conditions of that one according the invention. In practice, the energy efficiency of the refrigeration device 100 according to the invention is greatly improved.

In addition, by making further considerations on the refrigeration load of the compressor in the two afore compared refrigeration devices, i.e. the refrigeration device 100 and the refrigeration device 300, and in the light of the displacement between the two reciprocating compressors 101 and 101' being substantially similar, this hypothesis being close to the truth, the following results will be obtained:

$$Q/Q'=[\sigma_{12}(1-X1-X2)*(h_1-h_6)]/[\sigma_1'(h_1'-h_4')]=2.1$$

Wherein:

Q is the refrigeration load of the refrigeration device 100 according to the invention;

Q' is the refrigeration load of the refrigeration device 300 according to the scheme of FIG. 5*a;*

$\sigma_{12}$ is the fluid density in the refrigeration device 100 and in the thermodynamic state 12;

$\sigma_1'$ is the fluid density in the refrigeration device 300 and in the thermodynamic state 1;

$h_1'$ is the fluid enthalpy in the refrigeration device 300 and in the thermodynamic state 1;

$h_4'$ is the fluid enthalpy in the refrigeration device 300 and in the thermodynamic state 4.

In practice, the refrigeration load of a compressor 101 operating in a refrigeration device 100, in which the pressure of the first fraction of flow rate $P_8$ entering the compressor 100 is such that $P_8-P_1\leq 4$ bar and in which the pressure of the second fraction of flow rate $P_{10}$ entering the compressor 100 is such that $P_{10}-P_1\leq 1$ bar, is twice than that one of a reciprocating compressor 101' that operates in a refrigeration device 300 of known art and has the same displacement.

It has to be noted that the herein described embodiment 100 comprises a first economizer branch 105 and a second economizer branch 120, however an embodiment free of the additional economizer branch 120 still allows reaching the objects of the present invention and is, therefore, included in the protection scope of the present invention. In this case, the flow rate entering the compressor 100 would be given by the difference between the total flow rate 1 and that one of the fraction of flow rate X1 to the economizer branch 105, and would be denoted by the reference 1−X1 rather than 1−X1−X2, as done heretofore.

In particular, according to the herein described embodiment, both the first inlet port 107 and the second inlet port 112 comprise a slit whose main dimension L is arranged on a plane P, P1 substantially transverse to the axis Z of the cylinder 120.

In particular, both the first inlet port 107 and the second inlet port 112 comprise a slit whose main dimension L is substantially transverse to the axis Z of the cylinder 110. In particular, the slit has a substantially rectangular-shaped surface, lying on the inner surface 110*c* of the cylinder 110, thus along an arc of a circle of the cylinder 110. More specifically, for example such a surface is obtained through a cutting by milling machine of the wall 110*a* of the cylinder 110, obtained with the rotation axis of the milling machine parallel to the axis Z of the cylinder 110 and forward direction of the milling machine orthogonal to the axis Z of the cylinder 110, in radial direction. Therefore the so obtained surface is substantially rectangular-shaped, despite the sides are not reciprocally connected by sharp edge, but are blent one to the other. Preferably, the ratio between the H height dimension and L length dimension (also main dimension), the latter being measured along the arc of a circle traveled by the slit along the inner surface of the cylinder 110*b* (see in particular the dotted line shown in FIG. 4*b*), is 0.2. In particular, the length has to be measured on a plane P, or P1, transverse to the axis of the cylinder Z and passing in the middle of the height H of the respective slit.

Note that, anyway, any slit having a dimensional ratio of height H to length L smaller than 0.5 still falls within the protection scope of the present invention. In addition it has to be noted that the slit, i.e. the surface extending on the inner face 110*c* of the cylinder 110, has lower and upper sides blent to the respective connecting sides, since it follows the shape of the wall 110*a* of the cylinder 110 itself.

In particular, as visible in FIGS. 3*a* to 3*d*, the first port 107 has a lower side 107*a* substantially flush with the bottom dead centre I of the piston 111. More specifically, the lower side 112*a* of the second port 112 is flush with the upper side 107*b* of the first port 107.

According to the herein shown embodiment, both the first secondary economizer branch 105 and the additional secondary economizer branch 120 have a pipe 132 with a cylindrical section and a fitting 133 converging to the respective inlet port, i.e. to the first port 107 and to the second port 112. In particular, such a cylindrical pipe 132 is dimensioned so that to be of tuned type. It has to be noted that a similar convergent fitting (not shown herein) is also placed between the pipe 132 and the outlet of the heat exchanger 131 located downstream of the same pipe 132.

Figure 4A:
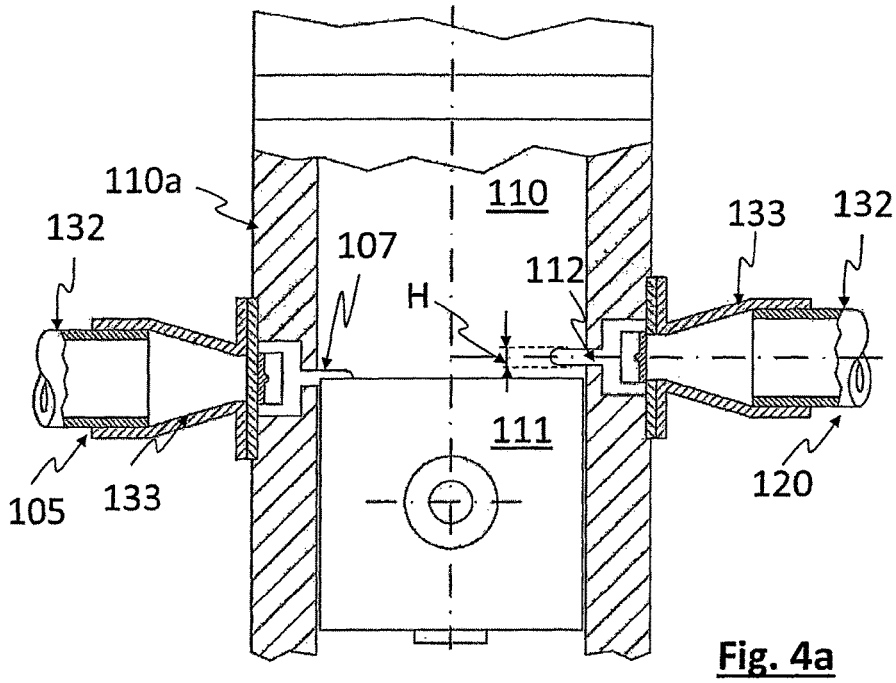
FIGS. 4*a* and 4*b* are respectively two longitudinal and transverse sectional views of the cylinder of the reciprocating compressor, with particular reference to the first and the second port obtained in the wall of the compressor cylinder.
Figure 4B:
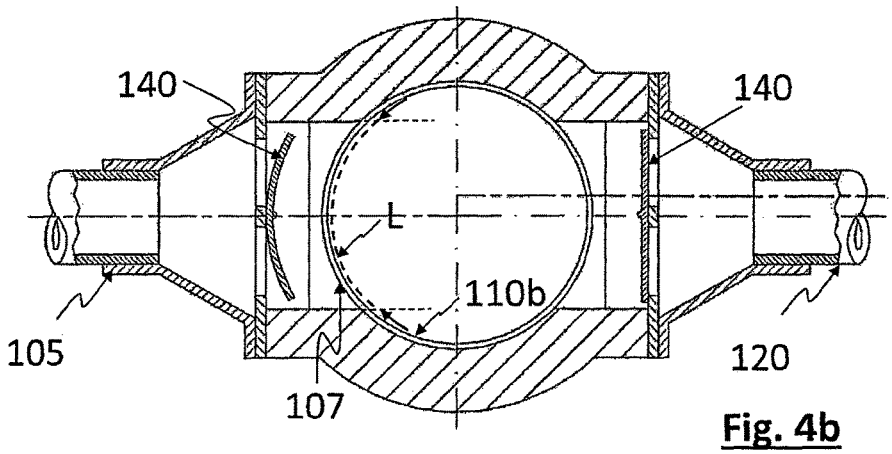

According to the embodiment shown in the FIGS. 3*a* to 3*d*, only the second inlet port 112 comprises a functionally-combined non-return valve 140; on the contrary, in the embodiment shown in FIGS. 4*a* and 4*b*, both the first inlet port 107 and the second inlet port 112 have a functionally-combined non-return valve of deformable reed type.

Such a non-return valve 140 is in practice dimensioned so as to deform only after a defined pressure is exceeded. Furthermore, such a non-return valve 140 is housed in the wall 110*a* of the cylinder 110 of the compressor 101.

The operation of the reciprocating compressor being in the refrigeration device 100 is explained in FIGS. 3*a* to 3*d*. In practice, during the inlet step of the compressor, i.e. when the piston 111 of the compressor 101 slides downwards from the top dead centre S to the bottom dead centre I, the suction valve 101*a* of the compressor is open to accommodate the flow rate of fluid 1−X1−X2 coming from the main circuit M and in the thermodynamic state 1 (see FIG. 3*a*). Subsequently, the piston 111 exposes the second port 112 from which a second fraction X2 of flow rate from the additional secondary economizer branch 120 comes; due to the pressure increase, the valve 101*a* closes. The pressure $P_{10}$ of such a second fraction X2 of flow rate is higher than the pressure $P_1$ being in the cylinder 110, thus resulting in a pressure increase inside the cylinder 110 (thermodynamic state 11). Of course during such a step the non-return valve 140 remains open (see FIG. 3*b*).

Then, the piston exposes the first port 107 thus allowing the access of the first fraction X1 coming from the secondary economizer branch 105 to the cylinder 110. Of course, the pressure $P_8$ of the first fraction X1 of flow rate coming from such a first economizer branch 105 is higher than the pressure of the second fraction X2 of flow rate and than the suction pressure $P_1$, however, advantageously, such a pressure $P_8$ does not exceed the pressure of the flow rate 1−X1−X2 entering the compressor 101 and coming from the main branch M for more than 4 bar. In any case, since the mixing there is an increase of the pressure in the compressor 101 (thermodynamic state 12), before the latter starts its compression stroke. Subsequently, the piston 111 rises again and compresses the fluid in the cylinder 110, until reaching the top dead centre S. When the pressure in the cylinder exceeds the condensation pressure, the opening of the exhaust valve 101*b* occurs. It has to be noted that during the rising of the piston 111, the non-return valve 140 placed in the part 110*a* of the cylinder 110 remains closed as the pressure in the cylinder exceeds the pressure of the flow rate coming from the additional secondary economizer branch 120.

The invention claimed is:

1. A refrigeration device having a closed circuit (C) in which a flow rate of coolant is circulating, said closed circuit comprising a condenser and a main branch (M) provided with a reciprocating compressor inside which a defined flow rate (1−X1; 1−X1−X2) of said coolant enters, from said main branch, at a defined suction pressure ($P_1$), of an evaporator and a first expansion valve that is arranged between said condenser and said evaporator, said closed circuit further comprising a first secondary economizer branch for a first fraction of flow rate (X1) of said coolant, said first secondary economizer branch fluidically connecting said compressor to a section of said closed circuit (C) comprised between said condenser and said first expansion valve, wherein said compressor comprises a first side inlet port for the entrance of said first fraction (X1) of coolant flow rate, said first fraction of flow rate having an inlet pressure ($P_8$) so that $P_8-P_1 \leq 4$ bar, wherein said reciprocating compressor is provided with a cylinder and a piston reciprocatingly moving in said cylinder, between a top dead center (S) and a bottom dead center (I), said first side inlet port for the entrance of said first fraction (X1) of flow rate of said coolant being arranged at the bottom dead center of said piston, so that said piston exposes at least in part said first side inlet port, at least during its inlet stroke, and covers said first side port, at least during its compression stroke.

2. The device according to claim 1, wherein said closed circuit further comprises an additional secondary economizer branch for a second fraction of flow rate (X2) of said coolant, said compressor comprising a second inlet port for the entrance of said additional fraction (X2) of flow rate of coolant into said compressor, in which said second port is arranged at a distance from said bottom dead center greater than the distance at which said first port is arranged, said additional fraction of flow rate (X2) having an inlet pressure ($P_{10}$) so that $P_1 \leq P_{10} \leq P_8$.

3. The refrigeration device according to claim 1, wherein said first inlet port and/or said second inlet port comprises/comprise a slit having a main dimension (L) substantially transverse to the axis (Z) of said cylinder.

4. The refrigeration device according to claim 3, wherein said slit comprises a substantially rectangular-shaped surface lying on the inner cylindrical surface of said cylinder.

5. The refrigeration device according to claim 4, wherein the ratio between the height (H) and the length (L) dimensions of said slit is less than 0.5.

6. The refrigeration device according to claim 1, wherein said first port has a lower side substantially flush with the bottom dead center of said piston.

7. The refrigeration device according to claim 6, wherein the lower side of said second port is flush with the upper side of said first port.

8. The refrigeration device according to claim 1, wherein said secondary economizer branch and/or said additional secondary economizer branch comprises/comprise a second expansion valve and a heat exchanger with said section of main branch between said condenser and said expansion valve.

9. The refrigeration device according to claim 1, wherein said secondary economizer branch and/or said additional secondary branch comprises/comprise a pipe having a cylindrical section and a fitting with said first inlet port and/or said second inlet port.

10. The device according to claim 9, wherein said cylindrical pipe is dimensioned so that to be of tuned type.

11. The device according to claim 1, wherein said first inlet port and/or said second inlet port comprises/comprise a functionally-combined non-return valve.

12. The device according to claim 11, wherein said non-return valve is of deformable reed type.

13. The device according to claim 12, wherein said non-return valve is housed in a wall of said cylinder.

* * * * *